US007267753B2

(12) United States Patent
Anex et al.

(10) Patent No.: US 7,267,753 B2
(45) **Date of Patent: *Sep. 11, 2007**

(54) ELECTROKINETIC DEVICE HAVING CAPACITIVE ELECTRODES

(75) Inventors: Deon Anex, Livermore, CA (US); Phillip Paul, Livermore, CA (US); David W. Neyer, Castro Valley, CA (US)

(73) Assignee: Eksigent Technologies LLC, Dublin, CA (US)

( * ) Notice: Subject to any disclaimer, the term of this patent is extended or adjusted under 35 U.S.C. 154(b) by 164 days.

This patent is subject to a terminal disclaimer.

(21) Appl. No.: 10/322,083

(22) Filed: Dec. 17, 2002

(65) Prior Publication Data

US 2004/0074784 A1 Apr. 22, 2004

Related U.S. Application Data

(63) Continuation-in-part of application No. 10/273,723, filed on Oct. 18, 2002.

(51) Int. Cl.
*F04F 11/00* (2006.01)
*C25B 9/00* (2006.01)

(52) U.S. Cl. ..... 204/600; 204/252; 204/450; 417/48

(58) Field of Classification Search ..... 204/252, 204/450, 600; 417/48
See application file for complete search history.

(56) References Cited

U.S. PATENT DOCUMENTS

| | | | | |
|---|---|---|---|---|
| 1,063,204 | A | 6/1913 | Kraft | |
| 2,615,940 | A | 10/1952 | Williams | 171/330 |
| 2,644,900 | A | 7/1953 | Hardway, Jr. | 310/2 |
| 2,644,902 | A | 7/1953 | Hardway, Jr. | 310/2 |
| 2,661,430 | A | 12/1953 | Hardway, Jr. | 310/2 |

(Continued)

FOREIGN PATENT DOCUMENTS

| | | | |
|---|---|---|---|
| CN | 2286429 | Y | 7/1998 |

(Continued)

OTHER PUBLICATIONS

Adamson A.W. et al., *Physical Chemistry of Surfaces*, pp. 185-187 (Wiley, NY 1997), no month.

(Continued)

*Primary Examiner*—Roy King
*Assistant Examiner*—William T. Leader
(74) *Attorney, Agent, or Firm*—Anna Lynne Heinkel; Sheldon Mak Rose & Anderson

(57) ABSTRACT

An electrokinetic device is capable of operating for extended periods of time, e.g. days to a week, without producing significant gaseous byproducts and without significant evolution of the pump fluid. Features of the electrokinetic device include: the electrodes in the electrokinetic device are capacitive with a capacitance of at least $10^{-4}$ Farads/cm$^2$; at least part of the inner surfaces of the electrodes have an area greater than the effective area of the porous dielectric material; at least part of the inner surfaces of the electrodes have a current flux less than 20 microamperes/cm$^2$; and at least part of the inner surfaces of the electrodes have a current flux that varies by less than a factor of two. The electrokinetic device can have one or several of these features in any combination.

24 Claims, 8 Drawing Sheets

U.S. PATENT DOCUMENTS 2,995,714 A 8/1961 Hannah ..... 331/107
3,143,691 A 8/1964 Hurd ..... 317/231
3,209,255 A 9/1965 Estes et al. ..... 324/94
3,298,789 A 1/1967 Mast et al.
3,427,978 A 2/1969 Hanneman et al. ..... 103/1
3,544,237 A 12/1970 Walz ..... 417/48
3,630,957 A 12/1971 Rey et al.
3,682,239 A 8/1972 Abu-Romia ..... 165/1
3,923,426 A 12/1975 Theeuwes ..... 417/48
4,383,265 A 5/1983 Kohashi
4,396,925 A 8/1983 Kohashi
4,402,817 A 9/1983 Maget
4,999,069 A 3/1991 Brackett et al.
5,037,457 A 8/1991 Goldsmith et al.
5,041,181 A 8/1991 Brackett et al.
5,126,022 A 6/1992 Soane et al.
5,534,328 A 7/1996 Ashmead et al.
5,573,651 A 11/1996 Dasgupta et al. ..... 204/601
5,581,438 A * 12/1996 Halliop ..... 361/502
5,683,443 A 11/1997 Munshi
5,858,193 A 1/1999 Zanzucchi et al. ..... 204/601
5,888,390 A 3/1999 Craig
5,942,093 A 8/1999 Rakestraw et al. ..... 204/450
5,958,203 A 9/1999 Parce et al.
RE36,350 E 10/1999 Swedberg
5,961,800 A 10/1999 McBride et al. ..... 204/450
5,964,997 A 10/1999 McBride
5,989,402 A 11/1999 Chow et al.
5,997,708 A 12/1999 Craig
6,007,690 A 12/1999 Nelson et al.
6,012,902 A 1/2000 Parce ..... 417/48
6,013,164 A 1/2000 Paul et al. ..... 204/450
6,019,882 A 2/2000 Paul et al. ..... 204/450
6,054,034 A 4/2000 Soane et al.
6,068,243 A 5/2000 Hoggan ..... 256/34
6,068,767 A 5/2000 Garguilo et al. ..... 210/198.2
6,074,725 A 6/2000 Kennedy
6,080,295 A 6/2000 Parce et al.
6,086,243 A 7/2000 Paul et al. ..... 366/273
6,100,107 A 8/2000 Lei et al.
6,106,685 A 8/2000 McBride et al. ..... 204/600
6,126,723 A 10/2000 Drost et al.
6,129,973 A 10/2000 Martin et al.
6,156,273 A 12/2000 Regnier et al.
6,171,067 B1 1/2001 Parce
6,176,962 B1 1/2001 Soane et al.
6,210,986 B1 4/2001 Arnold et al.
6,224,728 B1 5/2001 Oborny et al. ..... 204/450
6,255,551 B1 7/2001 Shapiro et al. ..... 588/204
6,267,858 B1 7/2001 Parce et al.
6,277,257 B1 8/2001 Paul et al. ..... 204/450
6,287,440 B1 9/2001 Arnold et al. ..... 204/450
6,290,909 B1 9/2001 Paul et al. ..... 422/70
6,320,160 B1 11/2001 Eidsnes et al.
6,344,145 B1 2/2002 Garguilo et al.
6,352,577 B1 3/2002 Martin et al.
6,406,605 B1 6/2002 Moles ..... 204/601
6,409,698 B1 6/2002 Robinson et al.
6,418,968 B1 7/2002 Pezzuto et al.
6,444,150 B1 9/2002 Arnold
6,460,420 B1 10/2002 Paul et al. ..... 73/861.52
6,472,443 B1 10/2002 Shepodd
6,477,410 B1 11/2002 Henley et al. ..... 604/20
6,495,015 B1 12/2002 Schoeniger et al.
6,529,377 B1 3/2003 Nelson et al.
6,689,373 B2 2/2004 Johnson et al.
6,719,535 B2 4/2004 Rakestraw et al.
6,729,352 B2 5/2004 O'Connor et al.
6,755,211 B1 6/2004 O'Connor et al.
6,770,182 B1 8/2004 Griffiths et al.
6,814,859 B2 11/2004 Koehler et al.
2001/0008212 A1 7/2001 Shepodd et al. ..... 204/451
2002/0048425 A1 4/2002 McBride et al.
2002/0056639 A1 5/2002 Lackritz et al.
2002/0059869 A1 5/2002 Martin et al.
2002/0066639 A1 6/2002 Taylor et al.
2002/0070116 A1 6/2002 Ohkawa ..... 204/603
2002/0089807 A1 7/2002 Bluvstein
2002/0125134 A1 9/2002 Santiago et al. ..... 204/450
2002/0166592 A1 11/2002 Liu et al.
2002/0185184 A1 12/2002 O'Connor et al.
2002/0187074 A1 12/2002 O'Connor et al.
2002/0187557 A1 12/2002 Hobbs et al.
2002/0189947 A1 12/2002 Paul et al.
2002/0195344 A1 12/2002 Neyer et al.
2003/0052007 A1 3/2003 Paul et al.
2003/0061687 A1 4/2003 Hansen et al.
2003/0116738 A1 6/2003 O'Connor et al.
2003/0143081 A1 7/2003 Rakestraw et al.
2003/0150792 A1 8/2003 Koehler et al.
2003/0198130 A1 10/2003 Karp et al.
2003/0198576 A1 10/2003 Coyne et al.
2003/0206806 A1 11/2003 Paul et al.
2003/0226754 A1 12/2003 Le Febre et al.
2004/0011648 A1 1/2004 Paul et al.
2004/0074768 A1 4/2004 Anex et al.
2004/0087033 A1 5/2004 Schembri
2004/0101421 A1 5/2004 Kenny et al.
2004/0115731 A1 6/2004 Hansen et al.
2004/0118189 A1 6/2004 Karp et al.
2004/0129568 A1 7/2004 Seul et al.
2004/0163957 A1 8/2004 Neyer et al.
2004/0182709 A1 9/2004 Griffiths et al.
2004/0238052 A1 12/2004 Karp et al.
2004/0241004 A1 12/2004 Goodson et al.
2004/0241006 A1 12/2004 Taboryski et al.
2004/0247450 A1 12/2004 Kutchinski et al.
2005/0247558 A1 11/2005 Anex et al.

FOREIGN PATENT DOCUMENTS

EP 0421234 A2 10/1991
EP 1063204 A2 12/2000
JP 03-087659 4/1991
WO WO96/39252 12/1996
WO WO99/16162 4/1999
WO WO 2004/027535 A1 4/1999
WO WO 00/04832 3/2000
WO WO 00/55502 A1 9/2000
WO WO 00/79131 A1 12/2000
WO WO 01/25138 4/2001
WO WO 02/068821 A2 9/2002
WO WO 02/086332 A1 10/2002
WO WO 2004/007348 A1 1/2004

OTHER PUBLICATIONS

Ananthakrishnan, V. et al., *A.I. Ch.E. Journal*, 11(6):1063-1072 (Nov. 1965).
Aris, R., *Oxidation of organic sulphides. VI, Proc. Roy. Soc. (London)*, 235A:67-77, no date.
Burgreen, D. et al., *The Journal of Physical Chemistry*, 68(95):1084-1091 (May 1964).
Chatwin, P.C. et al., *J. Fluid Mech*., 120:347-358 (1982), no month.
Doshl, M.R. et al., *Chemical Engineering Science*, 33:795-804 (1978), no month.
Drott, J. et al., *J. Micromech. Microeng*. 7:14-23 (1997), no month.
Gan, W. et al. *Talanta* 51:667-675 (2000), no month.
Jessensky O. et al., *J. Electrochem. Soc*. 145(11): 3735-3740 (Nov. 1998).
Johnson, D.L. et al., *Physical Review Letters*, 37(7):3502-3510 (Mar. 1, 1988).
Johnson, D.L. et al., *Physical Review Letter*, 57(20):2564-2567 (Nov. 17, 1986).
Johnson, D.L. et al., *J. Fluid Mech*. 176:379-402 (1987), no month.

Kobatake, Y. et al., *J. Chem. Phys*. 40(8):2212-2218 (Apr. 1964).
Kobatake, Y. et al., *J. Chem. Phys*. 40(8):2219-2222 (Apr. 1964).
Ma, Y. et al., *Microporous and Mesoporous Materials*, 37:243-252(2000), no month.
Morrison, F.A. et al., *J. Chem. Phys*. 43:2111-2115 (1965), no month.
Nakanishi, K. et al., *Journal of Crystalline Solids*, 139:1-13 (1992), no month.
Paul, P.H. et al., *Micro Total Analysis Systems*, pp. 583-590 (2000), no month.
Paul, P.H. et al., *Micro Total Analysis Systems*, pp. 49-52 (1998), no month.
Peters, E C. et al., *Anal. Chem*. 69:3646-3649 (1997), no month.
Philipse, A.P., *Journal of Materials Science Letters*, 8: 1371-1373 (1989), no month.
Rastogi, R.P., *J. Scient. Ind. Res*., (28):284-292 (Aug. 1969).
Rice, C.L. et al., *J. Phys. Chem*. 69(11):4017-4024 (Nov. 1965).
Rosan, M.J., *Surfactants and Interfacial Phenomena*, Second Ed., John Wiley & Sons, pp. 32-107, no month.
Schmid, G. J. *Membrane Sci*. 150:159-170 (1998), no month.
Schmid, G. et al., *J. Membrane Sci*. 150:197-209 (1998), no month.
Taylor, G., *Prox. Roy. Soc*. (London) 21:186-203, no date.
Weston, A. et al., *HPLC and CE, Principles and Practice*, pp. 82-85, Academic Press, no date.
Wijnhoven, J. et al., *Science*, 281:802-804 (Aug. 7, 1998).
Yzawa, T., *Key Engineering Materials*. 115: 125-146 (1996), no month.
Uhlig, E. L. P., et al., "The electro-osmotic actuation of implantable insulin micropumps", Journal of Biomedical Materials Research, (1983), pp. 931-943, vol. 17.
Aris, R. On the dispersion of a solute in a fluid flowing through a tube. Proceedings of the Royal Society of London. Series A, Mathematical and Physical Sciences. 1956; 235(1200):67-77.
Baquiran, et al. Lippincott's Cancer Chemotherpy Handbook Second Edition. Lippincott, Philadelphia 2001.
Becker, et al. Polymer Microfabrication Method for Microfluidic Analytical Application. Electrophoresis. 2000; 21: 12-26.
Belfer, et al. Surface Modification of Commercial Polyamide Reverse Osmosis Membranes, J. Membrane Sci. 1988; 139: 175-181.
Chu, et al. Physicians Cancer Chemotherapy Drug Manual 2002. Jones and Bartlett Publisher. Massachusetts. 2002.
Churchill, et al. Complex Variables and Applications. McGraw-Hill, Inc. New York, 1990.
Conway, B.E. Electrochemical Supercapacitors Scientific Fundamentals and Technological Applications. Kluwer Academic/Plenum Publishers. 1999:12-13, 104-105, 192-195.
Conway, B.E. Electrochemical Capacitors Their Nature, Function, and Applications. Electrochemistry Encyclopedia. 2003. Available at http://electrochem.cwru.edu/ed/encycl/art-c03-elchem-cap.htm. Accessed May 16, 2006.
Gennaro, A.R. Remington: The Science and Practice of Pharmacy. 20th edition. Lippincott Williams & Wilkins. Philadelphia 2000.
Gleiter, et al. Nanocrystalline Materials: A Way to Solids with Tunable Electronic Structures and Properties? Acta Mater. 2001; 49:737-745.
Gongora-Rubio, et al. The Utilization of Low Temperature Co-fired Ceramics (LTCC-ML) Technology for Meso-scale EMS, a Simple Theristor Based Flow Sensor. Sensors and Actuators. 1999; 73 (3): 215-221.
Goodman and Gilman's The Pharmacological Basis of Therapeutics. 10th edition. McGraw-Hill Medical Publishing Division. 2001.
Gritsch, et al. Impendance Spectroscopy of Porin and Gramicidin Pores Reconstituted into Supported Lipid Bilayers on Indium-Tin-Oxide Electrodes. Langmuir. 1998; 14: 3118-3125.
Haisma, J. Direct Bonding in patent literature. Philips. J. Res. 1995;49:165-170.
Jackson, J.D. Classical Electrodynamics 2nd Edition. John Wiley & Sons, Inc. New York. 1962.
Jimbo, et al. Surface Characterization of Polyacrylonitrile Membranes: Graft-Polymerized with Ionic Monomers as Revealed by Zeta potential Measurements. Macromolecules. 1998; 31: 1277-1284.
Klein, E. Affinity Membranes: a 10 Year Review. J. Membrane Sci. 2000; 179:1-27.
Kotz, et al. Principles and applications of electrochemical capacitors. Electrochimica Acta. 2000; 45:2483-2498.
Martin, et al. Laminated Plastic Microfluidic Components for Biological and Chemical Systems. J. Vac. Sci. Technol. 1999; 17: 2264-2269.
Mroz, et al. Disposable Reference Electrode. Analyst. 1998; 123:1373-1376.
Roberts, et al. UV Laser Machined Polymer Substrates for the Develpment of Microdiagnostic Systems. Anal. Chem. 1997; 69: 2035-2042.
Skeel, R. Handbook of Cancer Chemotherapy. 6th edition. Lippincott Williams & Wilkins. 2003.
Stokes, V.K. Joining Methods for Plastics and Plastic Composites: An Overview. Poly. Eng. And Sci. 1989;29:1310-1324.
Takata, et al.. Modification of transport properties of ion exchange membranes XIV. Effect of molecular weight of polyethyleneimine bonded to the surface of cation exchange membranes by acid-amide bonding on electrochemical properties of the membranes. J. Membrance Sci. 2000; 179: 101-107.
Vinson, J. R. Adhesive Bonding for Polymer Composites. Polymer Eng. And Science. 1989; 29:1325-1331.
Watson, et al. Recent Developments in Hot Plate Welding of Thermoplastics. Poly. Eng. And Sci. 1989; 29: 1382-1386.
US 6,406,905, 06/2002, Parce et al. (withdrawn)

* cited by examiner

ELECTROKINETIC DEVICE HAVING CAPACITIVE ELECTRODES

CROSS-REFERENCE TO RELATED APPLICATIONS

This application is a continuation-in-part of U.S. patent application Ser. No. 10/273,723 filed Oct. 18, 2002, the entire disclosure of which is incorporated herein by reference in its entirety for any and all purposes.

BACKGROUND

Electrokinetic (also known as electroosmotic) flow devices in the prior art employ simple wire or wire mesh electrodes immersed in a fluid. In these prior art devices, gas produced by current flowing through the electrodes must be vented and pH evolution must be tolerated. Therefore, the current and hence, the flow rate of the fluid, are limited in order to limit the amount of gas produced and the rate of pH evolution. Some prior art ignores the pH evolution. Moreover, since gas is produced and must be vented, these prior art flow devices cannot operate for extended periods of time in a closed system.

Others, such as U.S. Pat. Nos. 3,923,426; 3,544,237; 2,615,940; 2,644,900; 2,644,902; 2,661,430; 3,143,691; and 3,427,978, teach mitigation of irreversible pH evolution by using a low conductivity fluid so as to draw as little current as possible. Hence, these prior art devices are only successful when operating for a limited amount of time or when operating at a low current and, hence, low flow rate, e.g., 0.1 mL/min.

U.S. Pat. No. 3,923,426 teaches periodic switching of the polarity of the electrodes to prolong the life of an electrokinetic flow device.

Accordingly, there is a need in the art for an electrokinetic pump that is capable of extended operation in a closed system without producing significant gaseous by-products and without significant evolution of the fluid in the pump ("pump fluid").

Further, and more specifically, there is a need in the art for a low flow rate (e.g. in the range of about 25 nL/min to 100 microliters/min) electrokinetic pump that is capable of extended operation (i.e. multiple days to greater than multiple weeks) in a closed system without producing gaseous by-products and without significant evolution of the fluid in the pump.

SUMMARY

The present invention provides an electrokinetic device capable of operating in a closed system without significant evolution of the pump fluid.

The electrokinetic device comprises a pair of electrodes capable of having a voltage drop therebetween and a porous dielectric material between the electrodes. The electrodes are made of a capacitive material having a capacitance of at least $10^{-4}$ Farads/cm$^2$.

In one embodiment, the electrodes have an inner surface proximate to the porous dielectric material and the electrodes are shaped so that the inner surfaces have a current flux of less than about 20 micoramperes/cm over at least a portion of the inner surface. In other embodiments, the current flux is less than about 2 microamperes/cm$^2$ over at least a portion of each inner surface. In some embodiments, the portion of the inner surfaces is greater than an effective area of the porous dielectric material.

In some embodiments, the inner surfaces have a current flux wherein the electrodes are shaped so that the current flux varies by less than a factor of two over at least a portion of each inner surface. In some embodiments, the current flux varies by less than 20% over at least a portion of each inner surface. In some embodiments, the portion of the inner surfaces is greater than an effective area of the porous dielectric material.

Some embodiments of the invention are capable of pumping fluid a fluid unidirectionally for a period of time. In some embodiments, the period of time is at least one day. In some embodiments, the period of time is at least six days.

In some embodiments of the invention, the electrodes are substantially annular, spherical, hemispherical, strip-like, or cylindrical.

Some embodiments of the invention include sensor electrodes attached to an apparatus for measuring the voltage drop across the porous dielectric material. Some embodiments also include a power supply operatively attached to the capacitive electrodes, wherein the measuring apparatus outputs the voltage drop across the porous dielectric material into the power supply and wherein the power supply adjusts the voltage drop across the porous dielectric material so that fluid moves through the porous dielectric material at a desired rate.

Alternatively, some embodiments of the invention include an electrokinetic device comprising:

(a) a substrate having a first and a second through-via;

(b) a porous dielectric material located inside the substrate and being in liquid communication with the through-vias;

(c) a first capacitive electrode located on the substrate adjacent to the first through-via, the first capacitive electrode having an inner surface proximate to the first through-via; and (d) a second capacitive electrode located on the substrate adjacent to the second through-via, the second capacitive electrode having an inner surface proximate to the second through-via;

wherein each inner surface has a current flux and wherein the electrodes are shaped so that the current flux varies by less than a factor of two over an area of the inner surfaces greater than an effective area of the porous dielectric material and wherein the current flux is less than about 20 microamperes/cm$^2$ over an area of the inner surfaces greater than an effective area of the porous dielectric material.

Some embodiments can also include:

(e) a first flexible barrier encapsulating the first through-via and the first electrode and forming a first reservoir;

(f) a second flexible barrier encapsulating the second through-via and the second electrode and forming a second reservoir;

(g) a first enclosure surrounding the first flexible barrier and having a first port;

(h) a second enclosure surrounding the second flexible barrier and having a second port; and (i) a conduit connecting the first port to the second port.

In some embodiments, there is a voltage drop between the electrodes, wherein the first reservoir contains and the porous dielectric material is saturated with an electrically conducting fluid so that the fluid moves from the first reservoir through the porous dielectric material and into the second reservoir and wherein a working fluid is contained between the second enclosure and the second flexible barrier so that as the electrically conducting fluid fills the second reservoir, the second flexible barrier expands and pushes the working fluid through the second port.

The embodiments of pumps described thus far may be included in various pump systems described herein.

BRIEF DESCRIPTION OF THE DRAWINGS

These and other features, aspects and advantages of the present invention will become better understood with regard to the following description, appended claims, and accompanying drawings where:

DESCRIPTION

Definitions

Figure 1:
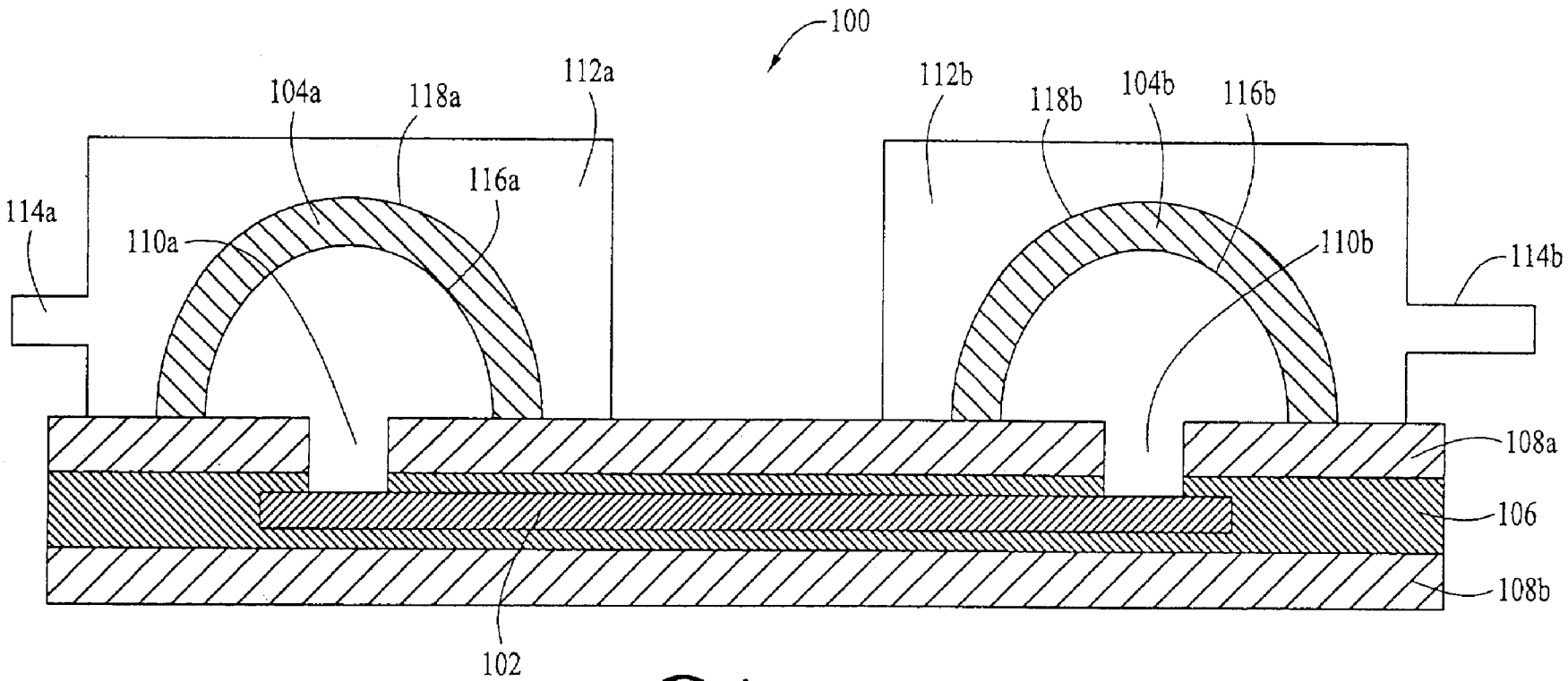
FIG. 1 is a cross-sectional view of an electrokinetic device in accordance with the present invention.

Double-layer capacitance—capacitance associated with charging of the electrical double layer at an electrode—liquid interface.

Pseudocapacitance—capacitance associated with an electrochemical oxidation or reduction in which the electrochemical potential depends on the extent of conversion of the electrochemically active species. It is often associated with surface processes. Examples of systems exhibiting pseudocapacitance include hydrous oxides (e.g. ruthenium oxide), intercalation of Li ions into a host material, conducting polymers and hydrogen underpotential deposition on metals.

Faradaic process—oxidation or reduction of a bulk material having an electrochemical potential that is (ideally) constant with extent of conversion.

Capacitance per area—the capacitance of an electrode material per unit of surface geometric area (i.e. the surface area calculated from the nominal dimensions of the material), having units Farads/$cm^2$. The geometric area is distinguished from the microscopic surface area. For example, a 1 cm by 1 cm square of aerogel-impregnated carbon paper has a geometric area of 1 $cm^2$, but its microscopic area is much higher. For paper 0.25 mm thick the microscopic area is in excess of 1000 $cm^2$.

Capacitive electrodes—electrodes made from a material having a double-layer capacitance per area, pseudocapacitance per area, or a combination of the two of at least $10^{-4}$ Farads/$cm^2$ and more preferably, at least $10^{-2}$ Farads/$cm^2$.

Pseudocapacitive electrodes—electrodes made from a material having a capacitance of at least $10^{-4}$ Farads/$cm^2$ resulting primarily from pseudocapacitance.

Effective electrode area-inner surface area of the electrode having a capacitance of at least $10^{-4}$ Farads/$cm^2$ where the current flux is less than about 20 microamperes/$cm^2$ and where the current flux varies by less than 20%.

Effective area of the porous dielectric material—the smallest cross-sectional area of the porous dielectric material that is perpendicular to the direction of fluid flow.

Structure

The present invention is directed to an electrokinetic device capable of achieving high as well as low flow rates in a closed system without significant evolution of the pump fluid. This invention is directed to electrokinetic pumps having a porous dielectric material between a pair of electrodes that provide for conversion of electronic conduction (external to the pump) to ionic conduction (internal to the pump) at the electrode-fluid interface without significant solvent electrolysis, e.g., hydrolysis in aqueous media, and the resultant generation of gas. The electrodes also work well in non-aqueous systems. For example, pumps embodying the invention can be used to pump a propylene carbonate solvent with an appropriate electrolyte, such as tetra(alkyl) ammonium tetrafluoroborate. Through the controlled release and uptake of ions in the pump fluid, the electrodes are designed to evolve the pump fluid in a controlled fashion.

The invention presented here addresses the need for compact and low flowrate electrokinetic devices, i.e. devices operating in the range of 5 nL/min to 10 microL/min, capable of operation for extended periods, i.e. minutes, hours, a day to weeks, in a closed system. This range of flowrates requires relatively small area electrokinetic devices, substantially less than one $cm^2$.

FIG. 1 shows an electrokinetic device 100 having a liquid saturated porous dielectric material 102 and capacitive electrodes 104*a* and 104*b*. Inside surfaces 116*a* and 116*b* of the electrodes 104*a* and 104*b* are proximate to the porous dielectric material 102. The porous dielectric material 102 is encapsulated within a bonding material 106 between upper and lower substrates 108*a* and 108*b*, respectively, as described in U.S. patent application Ser. No. 10/198,223 entitled Laminated Flow Device; invented by Phillip H. Paul, David W. Neyer, and Jason E. Rehm; filed on Jul. 17, 2002; and incorporated herein by reference. Alternatively, the porous dielectric material 102 and the capacitive electrodes 104*a* and 104*b* can be placed on an etched chip, for example, or incorporated into a flow system by any other means known in the art.

Through-vias 110*a* and 110*b* provide liquid connections between the porous dielectric material 102 and reservoirs 112*a* and 112*b*. The reservoir 112*a* and 112*b* each have a liquid port 114*a* and 114*b*, respectively, and each contain a capacitive electrode 104*a* and 104*b*, respectively. Preferably an electrical lead (not shown) is placed in contact with the electrodes 104*a* and 104*b* for connecting the electrode to a power supply (not shown). When operating, the spaces between the porous dielectric material 102 and the electrodes 104*a* and 104*b* are filled with electrically conducting liquid.

The run time of the electrokinetic device 100 at a certain flow rate before stopping the electrokinetic device, reversing direction of the electrokinetic device, or significant electrolysis of the fluid occurs is limited by the time it takes to charge up the capacitance of the capacitive electrodes 104*a* and 104*b* to the electrolysis threshold of the liquid. For a given electrokinetic device design (porous dielectric material, geometry and liquid), the run time/flow rate product can be increased by increasing the effective capacitance, i.e., of the capacitance that is available to accept and store charge delivered by ionic current flowing through the electrokinetic device, of the capacitive electrodes.

A first way to make the effective capacitance larger is to use capacitive electrodes that are large relative to the effective area of the porous dielectric material. Simply put, more electrode material subject to the electric field yields more capacitance. To this end, the inner surfaces 116*a* and 116*b* of the electrodes 104*a* and 104*b* proximate to the porous dielectric material 102 can be greater or at least 2 times, 10 times, or 100 times greater, for example, than the effective area of the porous dielectric material 102. The size of the capacitive electrodes 104*a* and 104*b* relative to the porous dielectric material 102 can be adjusted to meet runtime/flowrate product requirements.

A second way to make the effective capacitance larger is to lower the current density. Porous capacitive electrodes have higher capacitance when charged at lower current densities. To this end, the current flux over the inner surfaces 116*a* and 116*b* can be less than about 20 microamperes/$cm^2$ or 2 microamperes/$cm^2$, for example in order to meet runtime/flowrate requirements. Preferably, the current flux over the inner surfaces 116*a* and 116*b* of the electrodes 104*a* and 104*b* is substantially uniform, e.g., varying by less than a factor of 2, and more preferably, varying by less than 20%. A uniform current flux is desired in order to avoid an electrode-liquid potential that exceeds the hydrolysis or electrolysis potential of the fluid on a portion of the electrodes while trying to achieve the capacitance necessary for a desired flow rate/runtime product.

For every through-via shape, there is an electrode shape that provides a substantially uniform field at the electrode-liquid interface, hence a substantially uniform current flux. How such shapes are determined is known in the art see, for example J. D. Jackson, *Classical Electrodynamics*, (1975) and R. V. Churchill, and J. W. Brown, *Complex Variables and Applications* (1990). Common shapes that can be used include, but are not limited to: annular shapes and hemispherical shapes centered on circular though-vias and strip-like shapes and cylindrical shapes centered on rectangular through-vias.

The capacitive electrodes 104*a* and 104*b* shown in FIG. 1 have a substantially uniform field at the electrode-liquid interface when used with the through-vias 110*a* and 110*b* also shown in FIG. 1. In the illustrated example, the inner surface 116*a* of the capacitive electrode 104*a* is a hemispherical shaped shell and the capacitive electrode 104*a* is positioned so that if one drew an imaginary line representing the radius of the sphere partially formed by the inner surface 116*a*, the center of the through-via 110*a* would be at the center of the sphere. The same is true for the capacitive electrode 104*b*. In the illustrated example, the radius of the inner surfaces 116*a* and 116*b* are each about five times larger than the diameter of the through-vias 110*a* and 110*b*. The outer surfaces 118*a* and 118*b* of the capacitive electrodes 104*a* and 104*b* are also hemispherical. However, the outer surfaces 118*a* and 118*b* can take any convenient shape, for example, the outer surface 118*a* can be rectangular.

Leads

Preferably, the electrical contacts to the electrodes are formed from a metal, preferably platinum, that is electrochemically stable (i.e. not subject to redox reactions) under the electrochemical conditions encountered within the pump liquid environment. The electrical contacts may be in the form of a wire lead that may also serve as a flying lead, or a foil or as a thin layer deposited on an insulating support. Flying leads that are connected to the electrode contacting leads and do not contact the liquid may be of any type common in electrical components and wiring.

Electrodes

The electrode 104 preferably is made from a material having a double-layer capacitance of at least $10^{-4}$ Farads/$cm^2$, more preferably, at least $10^{-2}$ Farads/$cm^2$, and most preferably, at least 1 F/$cm^2$ as these electrodes can function with a wide range of pump fluids, i.e., any fluid having a pH value and an ionic content compatible with the porous dielectric material 102, whereas pseudocapacitive electrodes can function with a limited range of pump fluids as they need to be supplied reactants in order to avoid electrolysis of the pump fluid.

Carbon paper impregnated with carbon aerogel is the most preferable electrode material as it has a substantial double-layer capacitance and is free of sharp edges and points. The high capacitance of this material arises from its large microscopic surface area for a given geometric surface area. At high currents, (e.g. 1 mA per square cm) the double layer capacitance is about 10 mF/$cm^2$ and at low currents, (e.g. 1 microamp per square cm) the double-layer capacitance is about 1 F/$cm^2$.

Many other forms of carbon also have very large microscopic surface areas for a given geometric surface area and hence exhibit high double-layer capacitance. For example, shaped carbon aerogel foam, carbon mesh, carbon fiber (e.g., pyrolized poly(acrylonitrile) or cellulose fiber), carbon black and carbon nanotubes all have significant double layer capacitance. Capacitive electrodes can be formed of materials other than carbon, even though carbon is preferred as it is an inert element and therefore reactions are slow when the voltage applied to the electrodes accidentally exceeds the electrolysis threshold. Capacitive electrodes can be formed of any conductor having a high microscopic surface area, such as sintered metal. Well-known procedures can be used to increase then microscopic surface area of the electrodes, and thereby increase the capacitance, such as surface roughening, surface chemical etching, and platinization of platinum.

When pseudocapacitive electrodes are used, the electrode chemistry is arranged to minimize any irreversible electrochemical reactions that might alter the pump fluid and provide for conversion from electronic conduction to ionic conduction at the electrode-fluid interface, so that gaseous products are not produced and irreversible alteration of the pump fluid or electrode materials are not involved. This is accomplished by limiting the rate of unwanted chemical reactions at the electrodes 104*a* and 104*b* by careful optimization of the combination of: the pump fluid, electrode material, the porous dielectric material 102, physical geometry of the pump, the applied potential, and the current flux density at the electrodes 104*a* and 104*b*.

Examples of possible pseudocapacitive electrode-fluid combinations include:

1. Electrode Material or Coating That Represents a Solid Redox Couple.

This can be cobalt-, manganese-, iridium-, vanadium-, or ruthenium-oxides. These oxides are relatively insoluble in water and many other solvents. Advantage is taken of the multiple oxidation states of the metals but the redox reaction takes place in the solid phase and the charge can be carried as $OH^-$ or $H^+$ ions in the fluid.

2. A Solid Redox Host Material That Dispenses or Inserts a Soluble Ion.

This is commonly termed de-intercalation and intercalation, respectively. For example, $Li^+$ ions may be inserted into solids like manganese nitrides, titanium, molybdenum di-sulfides, carbon, and conducting polymers like polyaniline, polythiophene, and polyacetylenes. Redox reactions in the solid results in dispensing or uptake of the $Li^+$ ions to or from the fluid. These ions are stable when stored in the solid and solids with intercalated ions are stable when exposed to the transport fluid, although some are reactive with $H_2O$.

Electrodes can be formed in a number of ways. Planar electrodes, e.g. an annular disk, can be cut or punced from sheet-like electrode material. A sheet-like shape can be obtained by impregnating carbon aerogel into a carbon-fiber paper or by plating ruthenium-oxide onto a sheet of metal or a metal screen. Three-dimensional electrodes, e.g. a hemispherical shell, can be directly cast to shape or machined out of block-like materials. Bulk or block like materials can be obtained in the form of carbon aerogel foam or by plating ruthenium oxide onto a porous metal frit.

For construction where flow is through the electrode it is preferable that the electrode be macroscopically porous so that the electrode presents minimal resistance to the flow. Specifically, it is preferable that the flow permeability of the electrode is at least 10 and, more preferably, at least 100 times that of the porous dielectric material. Alternatively, when the electrode material is not microscopically porous, the electrode can have a hole to provide for the flow.

The electrode thickness (dimension in the axial direction) is preferably several times greater than the field penetration depth. Making the electrode even thicker does not appreciably increase the effective capacitance of the electrode. However, a thicker electrode can be employed to add mechanical strength to the electrode. The thickness of the electrode is preferably at least 0.5 mm and, more preferably, at least 1 mm and, and most preferably, at least 2 mm.

It is preferable that the electrode material be insoluble in the liquid in contact with the electrode. It is preferable that the electrode material have an electrical conductivity that is substantially greater, preferably at least 1000 times greater, than that of the liquid, e.g., the conductivity of a carbon aerogel foam is about 100 mho/cm, which is substantially greater than the conductivity of a typical liquid used in an electrokinetic device, such as aqueous 5 mM NaCl, which has a conductivity of about $0.5\times10^{-3}$ mho/cm.

The electrodes are preferably washed and, if necessary, leached in the liquid prior to use to remove any soluble impurities or contaminants and, if necessary, to condition the electrode material to the ionic environment of the liquid. Porous electrodes are preferably degassed following immersion in the liquid so as to minimize any trapped air, maximize electrode-liquid contact, and remove trapped gases as a source of compressibility.

Porous Dielectric Materials

The porous dielectric material can be any known in the arts, including but not limited to: porous organic membranes, packed particles, packed silica beads, porous sintered ceramics, silica or alumina or titania porous aerogels, micromachined or stamped or embossed arrays, phase separated porous glasses (e.g. Vycor), phase separated porous ceramics and phase separated organics. A material with a high zeta potential and a narrow pore size distribution is desirable as it makes the pump 100 more efficient. Large pores cause the pump 100 to have reduced pressure performance and pores that are too narrow cause increased charge layer overlap, which decreases the flow rate. Whatever material is used, the pores preferably have a diameter in the range of 50-500 nm because it is desirable that the pores be as small as possible to achieve high pump stall pressure but still be large enough to avoid substantial double-layer overlap.

The stall pressure of an electrokinetic device is proportional to the product of electroosmotic mobility, liquid dynamic viscosity and applied potential divided by the square of the radius of the pore size. The pore size is preferably larger than the thickness of the double-layer otherwise the electroosmotic mobility is reduced, the conductivity of the electrolyte within the pores is increased, and a detrimental process of net concentration transport through the pores is introduced. Therefore, for a given pore size and a given potential difference there is some preferred minimum value of ionic strength (i.e. ionic concentration) that minimizes the conductivity hence the current and at the same time does not increase the double-layer thickness so as to substantially degrade flowrate, stall pressure and stable operation of the device. Preferably the ionic strength of the liquid is sufficient to provide a Debye length that is at least 10 times smaller than the diameter of the pores in the porous dielectric material.

Preferably, the mobilities of the ions in the fluid are less than 20 times, more preferably, less than 3 times and, most preferably, less than the magnitude of the electroosmotic mobility of the porous dielectric material 102. Where different combinations of counter-and co-ions give the same sum of ionic mobilities, the preferable combination is one with lower counter-ion mobility.

Additives to the fluid that provide polyvalent ions having a charge sign opposite to that of the zeta potential of the porous dielectric material are preferably avoided. For example, when the porous dielectric material 102 is comprised of a positive zeta potential material, phosphates, borates and citrates preferably are avoided. For a negative zeta potential material, barium and calcium preferably are avoided.

Use of Electrokinetic Devices Embodying the Invention

When the electrokinetic device is activated, a potential difference is applied between the electrodes and fluid moves from the reservoir 112*a* through the porous dielectric material 102 to the reservoir 112*b*. In time, owing to the current produced by the applied potential difference, the potential differences at the electrode-liquid interfaces will increase and the liquid will be de-ionized as ions from the liquid are collected on the capacitive electrodes 104*a* and 104*b*. It is preferable to maintain the total potential drop at the electrode-liquid interfaces below the liquid electrolysis potential, $\Delta V_{hy}$ in order to avoid production of gaseous products and pH evolution of the liquid. Hence, the uni-directional operating lifetime is preferably less than the time required to charge the electrode-liquid interface to a potential greater than that required to electrolyze the liquid. The electrolysis potential is generally less than a few volts. For water the hydrolysis potential is about 1.2V, for propylene carbonate the electrolysis potential is about 3.4V.

It is further preferable to start with a fluid having a sufficiently high ionic strength so that over the course of operation the ionic strength within the electrokinetic device does not fall below the preferred minimum ionic strength. Deionization of the liquid reduces the conductivity of the liquid in the electrokinetic device leading to a reduction of current over the time of operation. These conditions are quantified by equating the charge on the electrodes to the time-integral of current drawn through the electrokinetic device. This gives, in the limit that double-layer corrections are negligible, $$C_e\Delta V_e = fc_{min}v_{ol}(1+n_{co}/n_{cn})(exp((n_{cn}Qt)/(n_{eo}v_{ol}))-1) \quad (1)$$

where $v_{ol}$ is the volume of liquid in the reservoir 112*a*, $C_e$ is the capacitance of the electrodes, f is Faraday's constant, $c_{min}$ is the preferable minimum ionic strength, $\Delta V_e$ is the electrode-liquid potential difference that is preferably limited to values less than the electrolysis potential of the liquid, $n_{co}$ is the co-ion mobility, $n_{cn}$ is the counter-ion mobility, $n_{eo}$ is the electroosmotic mobility, Q is the flowrate and t is the time from starting operation.

The electroosmotic mobility is directly proportional to the zeta potential. For a zeta potential of −25 mV and an aqueous electrolyte, the electroosmotic mobility is about −1.88 (here mobilities are cited in units of $10^{-4}$ $cm^2$/Volt-sec), at a zeta potential of 50 mV the electroosmotic mobility is about 3.75. Note, in equation 1 the flowrate and the electroosmotic mobility always have the same sign, thus the argument of the exponential is always a positive number. For NaCl the ionic mobilities are about 5 and 7, respectively, whereas for TRIS/acetate the ionic mobilities are about 2.9 and 4.2, respectively. According to equation 1, to obtain the largest flowrate-runtime product, the ratio $n_{cn}/n_{eo}$ is preferably small. However in practice this ratio can be substantially greater than unity.

As an example application of equation 1: Consider a pump design requiring a flowrate of water of 100 nL/min delivered for one week. The zeta potential is −50 mV hence $n_{eo}$ is about −3.75. Using TRIS/acetate the counter-ion is $TRIS^+$ hence $n_{cn}/n_{eo}$ is about 0.8. For a liquid volume of twice the flowrate-runtime product (i.e. $v_{ol}$ is about 2 mL), and limiting the electrode-liquid potential drop to one Volt, gives: $C_e/c_{min}$=0.32 Farad/mM. For pore sizes in the range of 150 to 250 nm, a reasonable value of $c_{min}$ is in the range of about 1 to 5 mM. This then corresponds to required electrode capacitance values in the range of about 0.3 to 1.5 Farad. For an electrode capacitance of 1 Farad/$cm^2$, this corresponds to an inner surface area of about 0.3 to 1.5 $cm^2$. To put this in perspective, to achieve order one Farad of electrode capacitance with a planar metal electrode (a planar metal electrode provides a capacitance of about 10 μF/$cm^2$) requires an electrode area of about 10 square meters.

The effective electrode capacitance per unit electrode area is equal to the current flux (current per unit electrode area) divided by the rate-of-change of the electrode-liquid potential difference. It is well known that this effective capacitance can be a function of current flux. For example: For a porous carbon aerogel electrode in contact with an aqueous solution having an ionic strength of a few mM, the effective capacitance is about 0.01 F/$cm^2$ at a current flux of about 1 mA/$cm^2$, whereas the effective capacitance can be greater than 1 F/$cm^2$ at a current flux of about 0.001 mA/$cm^2$.

The desired strategy is to apply a current to the electrodes 104*a* and 104*b* to produce a desired flow rate for the desire run time while charging the capacitance of the electrodes. The double-layer capacitance or the pseudocapacitance of the electrodes 104*a* and 104*b* preferably is charged prior to the beginning of bulk Faradaic processes. Typical values of double layer capacitance of a plane metal surface (e.g. a drawn metal wire) are 20 to 30 micro Farads/$cm^2$. This value can be substantially increased using methods well known in the electrochemical arts (e.g. surface roughening, surface etching, platinization of platinum). The double-layer capacitance of the electrodes 104*a* and 104*b* is preferably at least $10^{-4}$ Farads/$cm^2$ and more preferably at least $10^{-2}$ Farads/$cm^2$.

When current flows through pseudocapacitive electrodes, reactants are consumed at the electrodes. When all of the reactants are consumed, gas is produced and the pump fluid may be irreversibly altered. Therefore, preferably the reactants are replenished or current stops flowing through the electrodes before all of the reactants are consumed. The rate that the reactants are supplied to the electrodes 104*a* and 104*b* preferably is high enough to provide for the charge transfer rate required by the applied current. Otherwise, the potential at the electrodes 104*a* and 104*b* will increase until some other electrode reaction occurs that provides for the charge transfer rate required by the current. This reaction may not be reversible.

Thus, when using pseudocapacitive electrodes, the current that can be drawn, hence the electrokinetic flow rate is limited by the transport rate of limiting ionic reactants to or from the electrodes 104*a* and 104*b*. The design of the electrokinetic device 100 when pseudocapacitive electrodes are used is thus a careful balance between: increasing ionic concentration to support reversible electrode reactions and decreasing ionic concentration to draw less current to prevent irreversible evolution of the electrokinetic device fluid.

When pseudocapacitive electrodes are used in the electrokinetic device 100, their electrochemical potential depends on the extent of conversion of the reactants. The dependence of the electrochemical potential on a reaction gives rise to current (I) and voltage (V) characteristics that are nearly described by the equations that characterize the capacitance processes. That is, although the electrodes technically depend on Faradaic processes, they appear to behave as a capacitor.

Figure 2A:
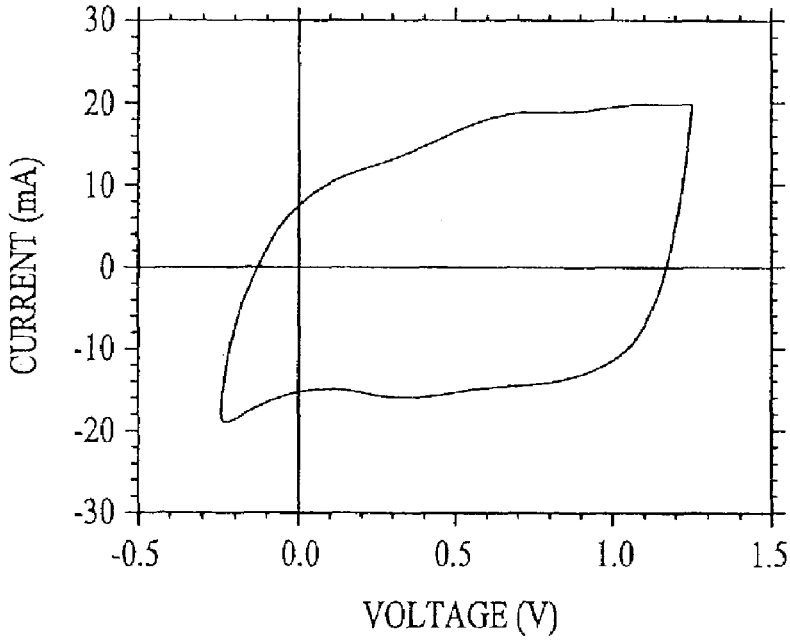
FIG. 2A is a current versus voltage plot for a ruthenium oxide pseudocapacitive electrode that can be used in the pump of FIG. 1.
Figure 2B:
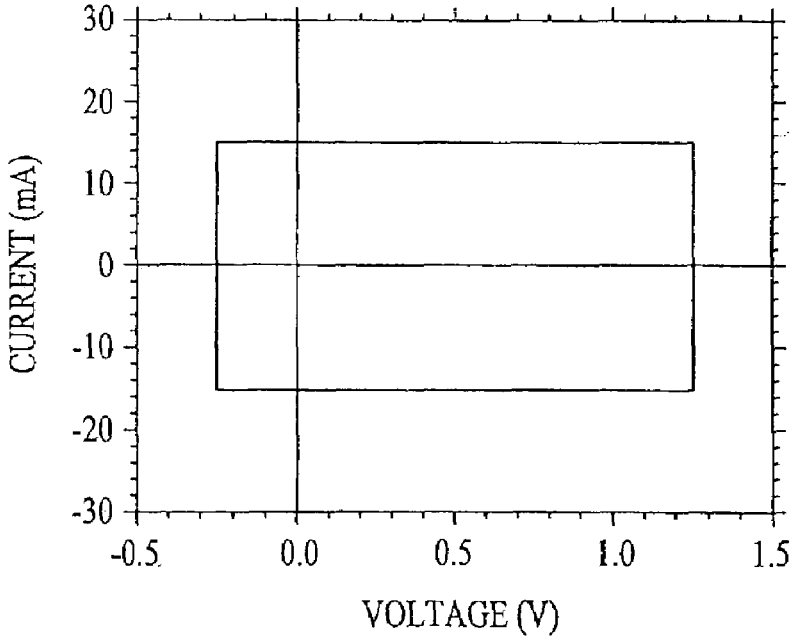
FIG. 2B is a plot of a calculated current versus voltage for a 5 milli Farad capacitor shown for comparative purposes.

An example of the current versus voltage behavior (a cyclic voltammogram) of a ruthenium oxide ($RuO_2$) pseudocapacitive electrode is given in FIG. 2A. The calculated cyclic voltammogram for a 5 mF capacitor is shown for comparison in FIG. 2B. The applied voltage waveform is a triangle wave with an amplitude of 1.5 V peak to peak and a period of 1 second (dV/dt=3 V/sec.) The surface area of the pseudocapacitive electrode was about 0.1 $cm^2$. In contrast, the cyclic voltammogram for an electrode based on bulk Faradaic processes would appear as a nearly vertical line in these plots. The current versus voltage behavior that arises from intercalation of an ion, e.g. $Li^+$, into a host matrix or a conducting polymer electrode is similar to that of a ruthenium oxide electrode.

Pseudocapacitive electrodes, which operate using a surface Faradaic electrochemical process, sacrifice some of the chemical universality of capacitive electrodes, which can be charged by almost any ion. Pseudocapacitance is usually centered on the uptake and release of a specific ion, $H^+$ for $RuO_2$ and $Li^+$ for intercalation, for example. Therefore, pseudocapacitive electrodes are compatible with a smaller number of liquids as $RuO_2$ systems are usually run under acidic conditions and many $Li^+$ intercalation compounds are unstable in water.

In general, electrokinetic devices embodying the invention can be controlled with either voltage or current programming. It is advantageous for the electrokinetic device 100 to have a low drive voltage so that it is suitable for integration into compact systems or for close coupling to sensitive electronic devices.

The electrokinetic device flow rate and pressure can be modulated by varying the electrical input. The electrical input can be varied manually or by a feedback loop. It may be desirable to vary the flow rate and/or the pressure, for example: to vary a heat transfer rate or stabilize a temperature in response to a measured temperature or heat flux; to provide a given flow rate or stabilize a flow rate in response to the signal from a flowmeter; to provide a given pressure or stabilize a pressure in response to a signal from a pressure gauge; to provide a given actuator displacement or stabilize an actuator in response to a signal from displacement transducer, velocity meter, or accelerometer.

Controlled Flow Operation.

Figure 3:
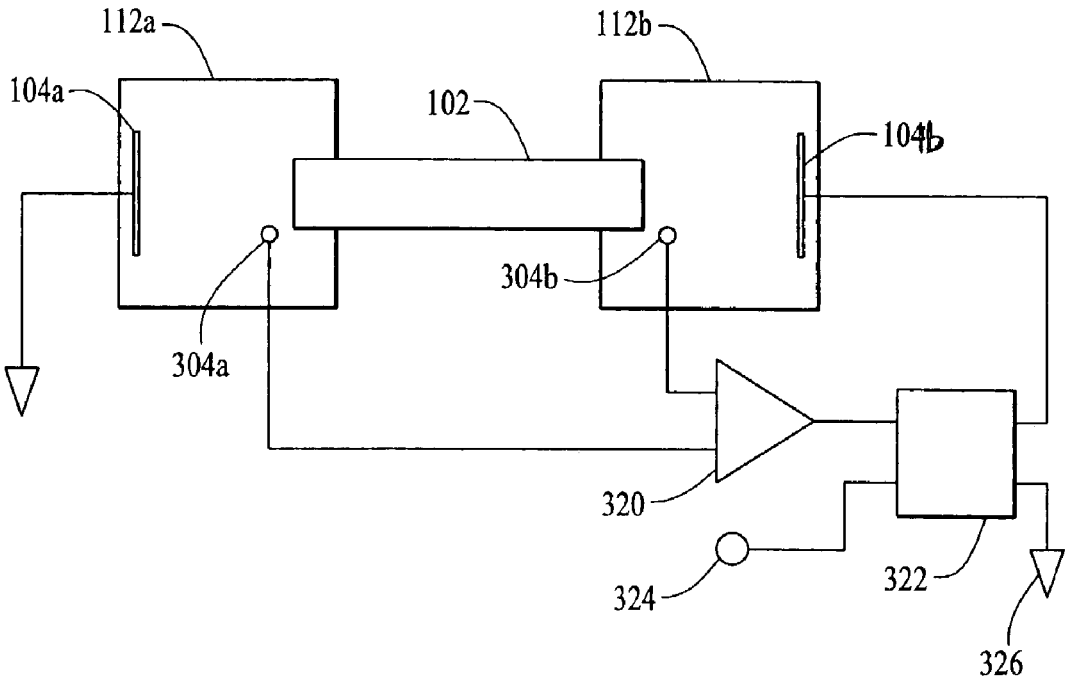
FIG. 3 is a schematic view of one embodiment of an electrokinetic device having sensor electrodes.

The combination of capacitive electrodes and a liquid-saturated electrokinetic device can be represented by the electrical equivalent circuit: A series combination of a capacitor (one electrode) a resistor (the liquid-saturated electrokinetic device) and a second capacitor (the other electrode). A potential difference, $\Delta V_a$, is applied across this circuit with a portion, $\Delta V_r$, appearing across the resistor and the balance appearing across the capacitors. It will be appreciated that the flowrate is directly proportional to $\Delta V_r$, the potential across the resistor and that this potential is not necessarily equal to the applied potential. Further, the potential difference across the capacitors increases with time of operation, thus the fraction of the applied potential across the resistor decrease with time of operation and this variation results in a proportional variation in the flowrate. In cases where the total applied potential is comparable to the liquid hydrolysis potential, this variation in flowrate can be significant and some correction is preferably made to maintain a desired flowrate. For electrokinetic devices designed to supply a variable flowrate, the range of predictable flowrate variation is limited by the knowledge of the potential across the electrokinetic device. FIG. 3 shows a schematic of a system that corrects for these effects.

In FIG. 3, the ends of the liquid-saturated porous dielectric material 102 terminate in liquid-filled reservoirs 112*a* and 112*b* that contain capacitive electrodes 104*a* and 104*b*. A pair of sensor electrodes 304*a* and 304*b* is located proximal to and on either end of the porous dielectric material 102. A device 320 measures the difference in potential between the sensor electrodes 304*a* and 304*b* and hence, the potential difference across the porous dielectric material 102. To reliably measure the potential difference across the porous dielectric material 102, the sensor electrodes 304*a* and 304*b* are preferably located proximal to the ends of the porous dielectric material so as to minimize the liquid resistances. However, it is preferable to locate the sensor electrodes 304*a* and 304*b* outside of a direct field path between the porous dielectric material 102 and the capacitive electrodes 104*a* and 104*b* to avoid the possibility of locally shorting-out the field by the presence of an object more conducting that the liquid.

The device 320 preferably has an electrical input impedance that is substantially greater than the resistance of the porous dielectric material 102, thus the output of the device 320 is proportional to the potential across the porous dielectric material 102. For example, the porous dielectric material 102 can have a thickness of about 0.1 mm, a length of 25 mm, a width of 4 mm and a formation factor of about 3.5, be saturated with aqueous 5 mM NaCl and have a resistance of about 10 MΩ. If 10 V were applied, the current through the porous dielectric material 102 would be about 1 microAmpere. The device 320 is preferably selected for an input bias current that is small compared to that through the porous dielectric material 102 and for both input differential and input common mode resistances that are large compared to the resistance of the liquid-saturated porous dielectric material. The requirements can be easily satisfied, in this example, using a common instrumentation amplifier, such as the Analog Devices AMP02 having an input bias current of less than 2 nanoAmperes, an input differential resistance of greater than 10 GΩ, and an input common-mode resistance of greater than 16 GΩ.

The output of the device 320 can be applied as an input to a power supply 322 to form a servo loop that maintains the potential between the sensor electrodes 304*a* and 304*b*, hence a desired flowrate. The power supply 322 can be equipped with a further input 324 to provide the capability to externally program a setpoint. Methods of using a potential difference to drive a servo power supply loop including programming inputs are well established in the art. In FIG. 3, one of the capacitive electrodes 104*a* is connected to the common 326 of the power supply 322. The circuit can equally be implemented with a differential power supply and with one of the sensor electrodes held at electrical common.

The sensors electrodes 304*a* and 304*b* are preferably electrochemically neutral with respect to the liquid, non-reactive, do not create an electrochemical potential with respect to each other, and do not short out the electrical field between the capacitive electrodes and the ends of the porous dielectric material. To this end, preferable materials for the sensor electrodes include but are not limited to: carbon filaments, platinum wire, platinized platinum wire, AgCl and other sensing electrodes known in the art . . . .

The flowrate through an electrokinetic device is known to vary with temperature. For an aqueous electrolyte, the flowrate can vary about 3% and 0.5% per degree centigrade for constant voltage and constant current modes of operation, respectively. The temperature can be measured, e.g. using a thermocouple or thermistor or solid-state sensor, and this signal used to apply a correction to the power supply to stabilize the flowrate as a function of device temperature.

Examples of Electrode, Porous Dielectric Material and Through-via Geometries

Figure 4A:
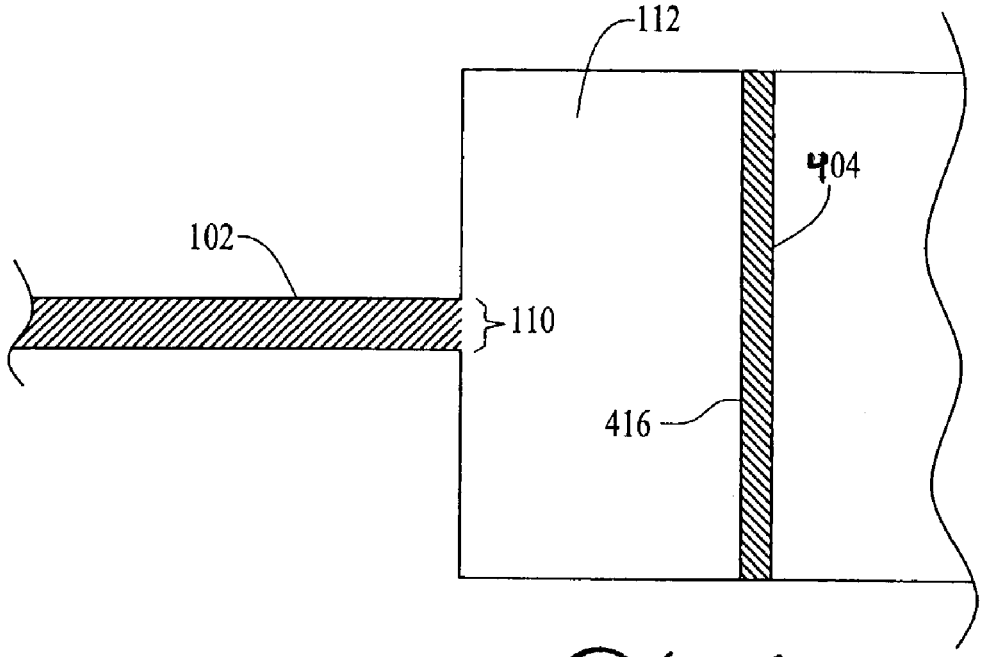
FIG. 4A is a cross-sectional view of a portion of one embodiment of an electrokinetic device in accordance with the present invention.
Figure 4B:
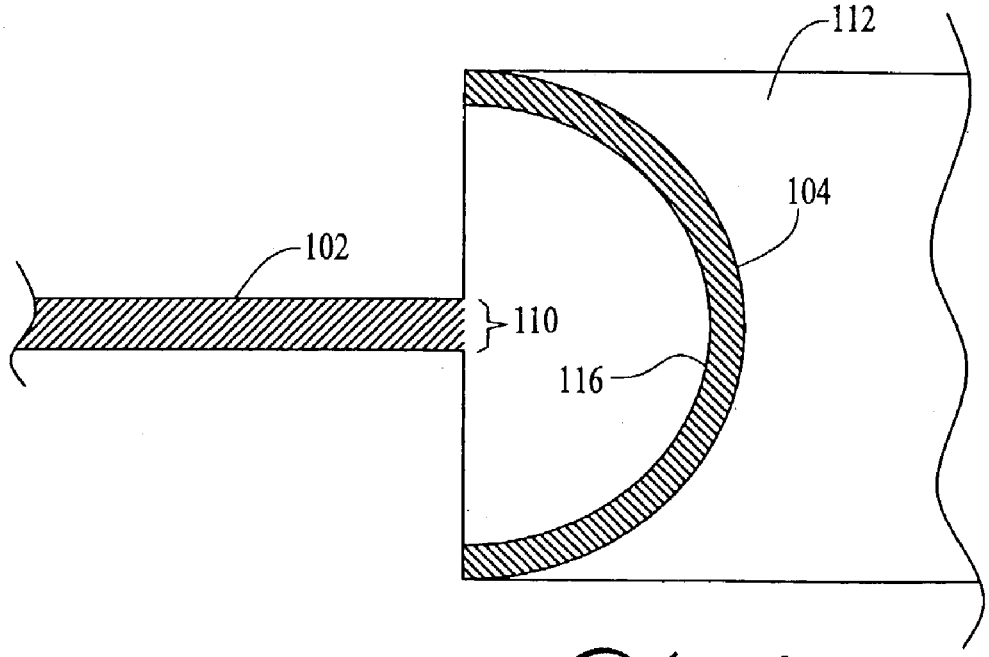
FIG. 4B is a cross-sectional view of a portion of one embodiment of an electrokinetic device in accordance with the present invention.

FIGS. 4A and 4B show another two possible geometries of the capacitive electrode 104 and the porous dielectric material 102. FIGS. 4A and 4B show sectional views of electrokinetic devices that can have either planar or cylindrical symmetry.

In FIG. 4A the inner surface 416 of the capacitive electrode 404 is substantially greater than the effective area of the porous dielectric material 102 and the length, end-to-end, of the electrode 404 is twice the distance between the porous dielectric material 102 and the electrode. The current flux on the electrode is non-uniform, being higher at the centerline than at the boundary of the electrode. If FIG. 4A has a cylindrically symmetric geometry, the current flux in the middle of the electrode 404 would be about 1.5 times that at the boundary of the electrode and the effective electrode area would be less than about 20% of the total electrode area.

In FIG. 4B the electrode 104 has an annular shape that is centered on the through-via 110. Comparing the electrode geometries illustrated in FIGS. 4A and 4B, it is easy to see the advantage of the annular shaped electrode 104. For cylindrical symmetry, the surface area of the electrode 104 is about twice that of the electrode 404 in FIG. 4A. Further, the current flux varies by less than 10% over the inner surface of the electrode 104 and the entire area of the inner surface of the electrode area equals the effective electrode area.

For cylindrical symmetry and where the lateral extent (distance measured from centerline to boundary) of the electrode 104 is about five times greater than the lateral extent of the porous dielectric material, the effective electrode area in FIG. 4A is about 16 times greater and the effective electrode area in FIG. 4B is about 160 times greater than the effective of the porous dielectric material.

Figure 5A:
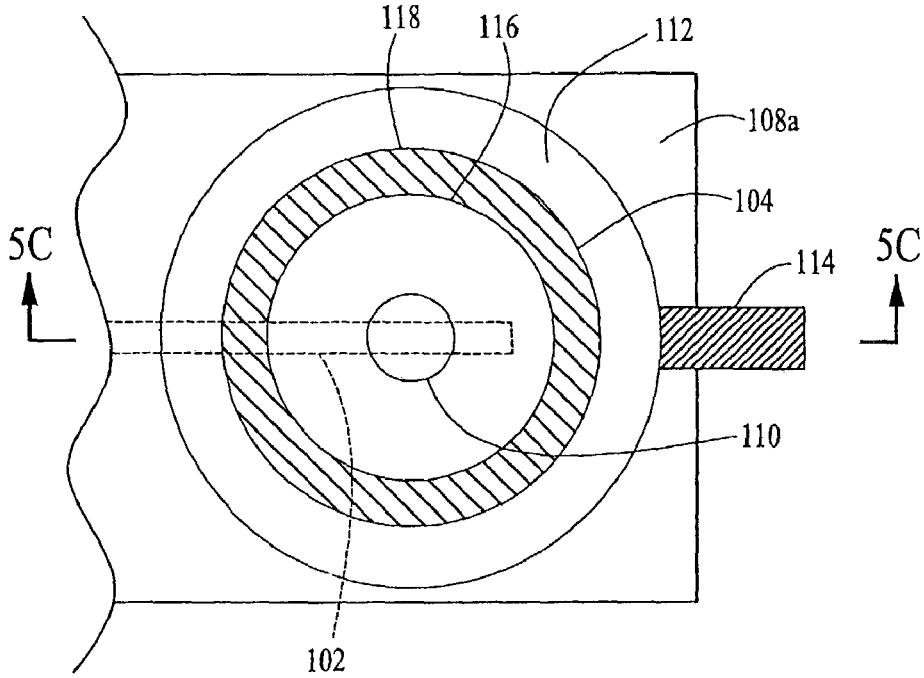
FIG. 5A is a top cross-sectional view of a portion of one embodiment of an electrokinetic device in accordance with the present invention.

In FIG. 5A the through-via 110 has a circular shape and the inner surface 116 of the capacitive electrode 104 is a hemispherical shell centered on the through-via. To achieve a relatively uniform current flux the radius of a hemispherical shell electrode is preferably about 5 times greater (or larger) than the long axis dimension of the through via.

Figure 5B:
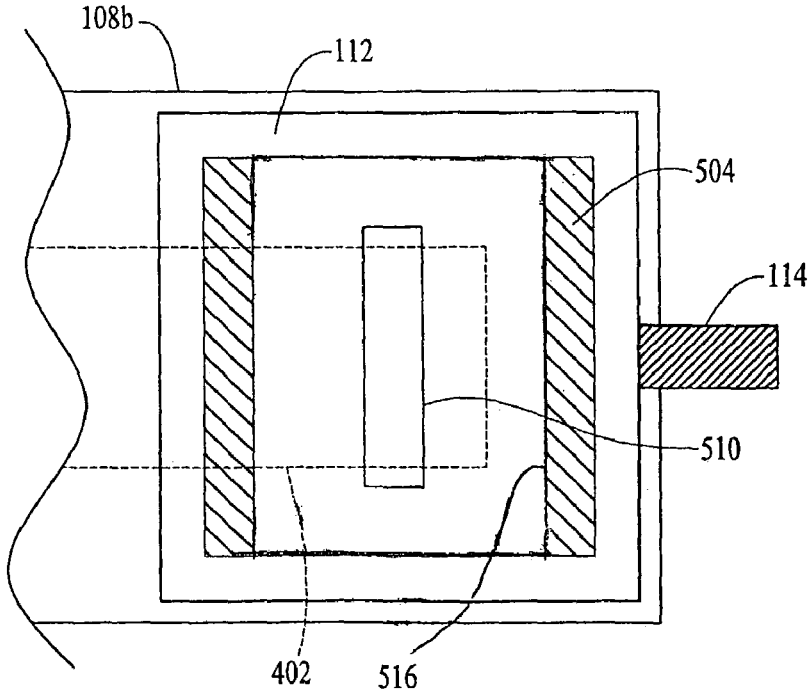
FIG. 5B is a top cross-sectional view of a portion of another embodiment of an electrokinetic device in accordance with the present invention.

In FIG. 5B, the through-via 410 has a rectangular shape and the inner-surface 416 of the electrode 404 is a semi-cylindrical shell centered on the through-via. The porous dielectric material 402 is in the shape of a strip. To achieve a relatively uniform current flux the radius of a cylindrical shell electrode is preferably about 5 times greater (or larger) than the short axis dimension of the through via. For relatively wide porous dielectric materials a cylindrical shell electrode geometry can provide a more compact construction than a spherical shell geometry.

Figure 5C:
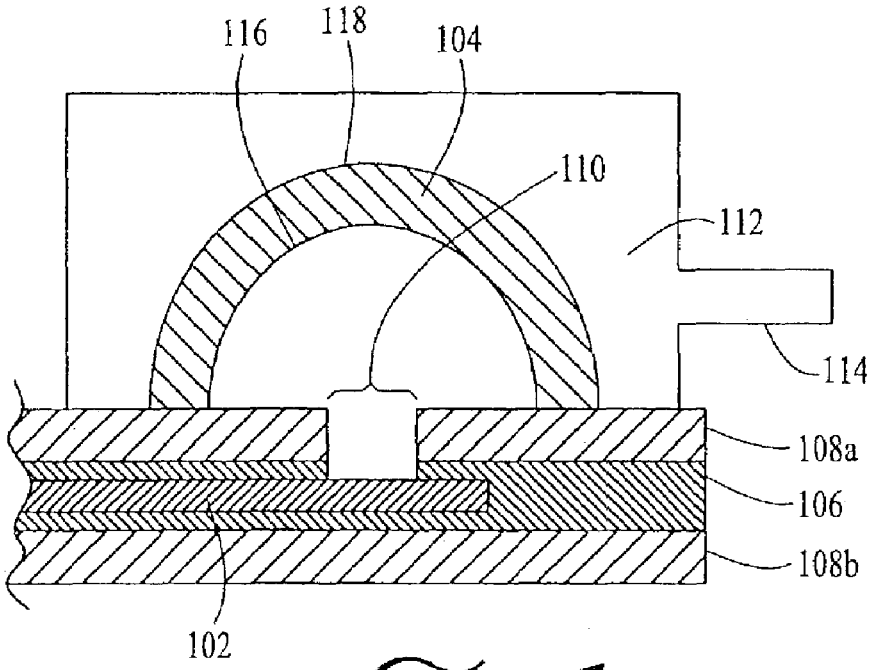
FIG. 5*c* is a cross-sectional view of the portion of the electrokinetic device of FIG. 5A.

FIG. 5C illustrates a sectional view of both of the embodiments illustrated in FIGS. 5A and 5B, however, the numbers correspond to FIG. 5A.

Figure 6:
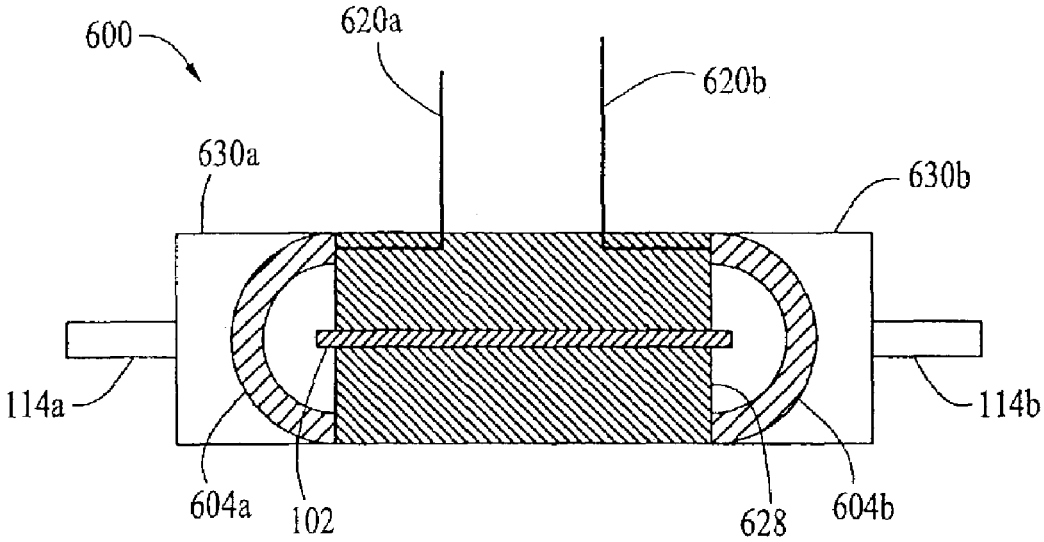
FIG. 6 is a cross-sectional view of another embodiment of an electrokinetic device in accordance with the present invention.

FIG. 6 shows a possible configuration of an electrokinetic device 600 in accordance with the invention. The porous dielectric material 102 is held within a liquid impermeable fixture 628. Porous capacitive electrodes 604*a* and 604*b* are in the form of hemispherical shells centered about the terminal ends of the porous dielectric material 102. Leads 620*a* and 620*b* are routed through the liquid impermeable fixture 628 and make contacts with the capacitive electrodes 604*a* and 604*b*. The components are held within housings 630*a* and 630*b* that are fitted with ports 114*a* and 114*b* that provide liquid input and output. The device 600 has a flow-through configuration where liquid enters through one port 114*a*, flows through one capacitive electrode 604*a*, then through the porous dielectric material 102, then through the second capacitive electrode 604*b*, then out the second port 116*b*.

Figure 7A:
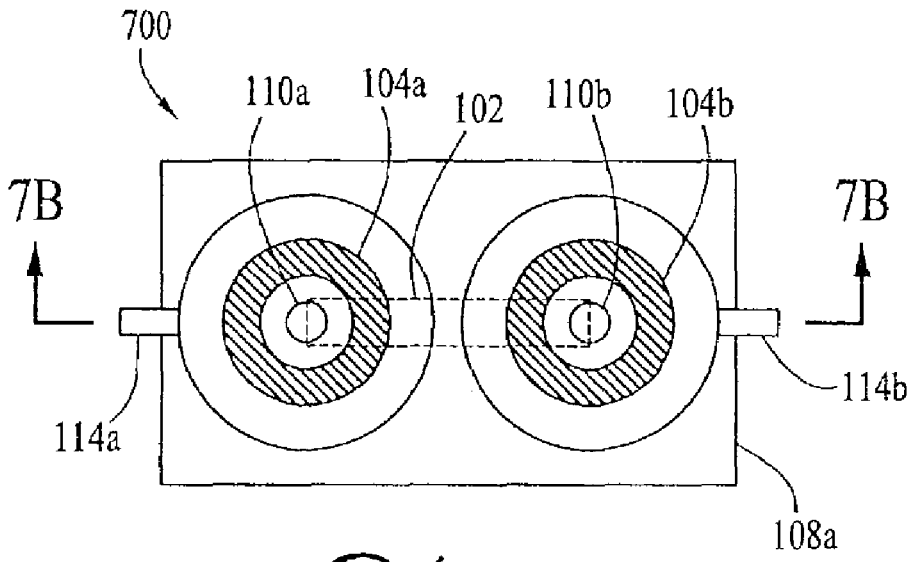
FIG. 7A is a top cross-sectional view of another embodiment of an electrokinetic device in accordance with the present invention.
Figure 7B:
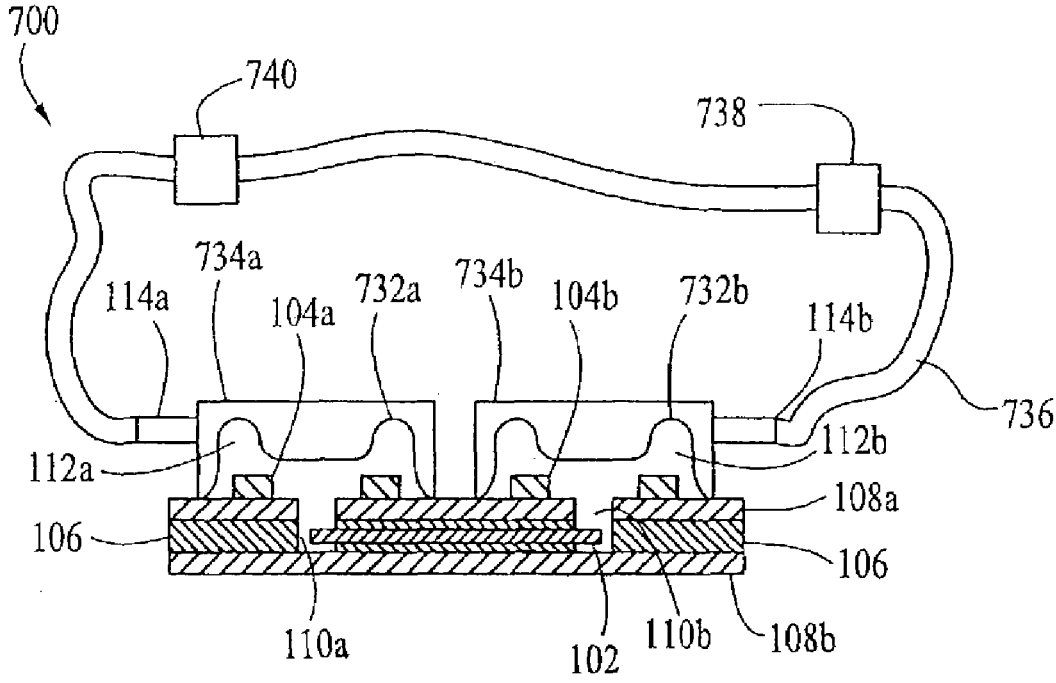
FIG. 7B is a cross-sectional view of the electrokinetic device in FIG. 7A.

Applications and More Examples of Electrode, Porous Dielectric Material and Through-Via Geometries FIGS. 7A and 7B illustrate on electrokinetic device 700 that can be used in an apparatus that continually monitors a body fluid, such as blood, for an extended period of time, several days to a week, for example.

In FIGS. 7A and 7B, impermeable flexible members 732*a* and 732*b*, which are flexible barriers, e.g. a diaphragm or a bellows, separates liquid in an electrokinetic device from a working fluid. The impermeable flexible members 732*a* and 732*b* encapsulate the through-vias 110*a* and 110*b*, the ends of the porous dielectric material 102, and the electrodes 104*a* and 104*b*. The working fluid is surrounded by enclosures 734*a* and 734*b* that are each equipped with the ports 114*a* and 114*b*. The electrodes 104*a* and 104*b* have an annular ring shape and lie parallel to the porous dielectric material 102. The through-vias 110*a* and 110*b* are circular. Alternatively, the through-vias can have a slot-like shape and each electrode can be in the form of two strips, one on each side of each through-via, for example.

In operation, liquid flows from the reservoir 112*a* through the porous dielectric material 102 and into the reservoir 112*b* thereby collapsing the impermeable flexible member 732*a* and distending the impermeable flexible member 732*b*, which in turn displaces the second liquid within the enclosure 734*b* through the port 114*b*. The working fluid can then circulate through an external loop or conduit 736, which can contain a means of obtaining a sample from the external environment 738 and a sample sensor 740, then flow back through the port 114*a* and into the enclosure 734*a*. This "push-pull" operation is useful for certain applications where it is preferable to maintain a sensor or sampling device in the external loop at ambient pressure. When the electrokinctic device is used for medical monitoring, the working fluid being pumped into the external loop can be Ringer's solutions and the working fluid can be Ringer's solution and a sample of body material when returning to the enclosure 734*a*.

Alternatively, the electrokinetic device 700 can be used to just "push" or pump a working fluid without "pulling" a working fluid into the enclosure 734*a*. Alternatively, the electrokinetic device 700 can be used to just "pull" or suction a working fluid into the enclosure 734*a* without "pushing" a working fluid out of the enclosure 734*b*, for example to draw blood or subcutaneous fluid. The electrokinetic device 700 can be "folded" so that the reservoirs 112*a* and 112*b* are stacked thereby changing the footprint of the device.

The device shown in FIG. 700 can be used to pump fluid unidirectionally for an extended period of time, for minutes, hours, days, a week or longer.

The fact that the electrodes 102 do not generate gas and do not alter the pH simplifies the design considerably. It eliminates the need to vent-to-ambient gases produced by electrolysis and eliminates the need to provide a means of controlling the pH of the fluid reservoir (e.g. ion exchange resin in the pump liquid reservoirs).

An indirect electrokinetic pump such as the one shown in FIGS. 7A and 7B can be used in cases where the working fluid is not compatible with electrokinetic flow, e.g. hydrocarbon fuels, propellants, pure solvents, liquids with a high salt content, liquids that do not support a zeta potential, liquids that have a low electrolysis potential, in cases where long-term storage or useable lifetime of the working fluid requires that it be separate from the liquid in the electrokinetic device, e.g. the working fluid must be refrigerated or frozen for storage, in cases where it is preferable to dispense the working fluid from a replaceable and/or disposable cartridge, or in cases where there is a need to maintain the absolute composition, purity, or sterility of the working fluid, e.g. for drug delivery or for medical diagnostics.

The impermeable flexible member preferably is comprised of metal in the form of a bellows or a convoluted diaphragm; or a multi-layer plastic film, glass, silicon, or nitride in the form of a convoluted diaphragm. Design and manufacture of flexible bellows and convoluted diaphragms using the aforementioned materials are well known in the art. Bellows or convoluted diaphragm constructions are preferred because the flexure of the impermeable flexible member is provided through bending rather than stretching of the material.

Thin polymer films are subject to pinhole defects created in manufacture or subsequent handling. Therefore, when they are used, it is preferably in the form of a multi-layer film as multi-layer films are generally free of pinhole defects. These films often combine layers of different plastics to add scratch resistance; mechanical toughness; reduced permeability to a variety of chemical compounds, e.g. a layer can be added that is highly impermeable to oxygen and a different layer can be added that is highly impermeable to water; chemical resistances, e.g. fluoropolymer coatings; and possibly surface layer materials for direct thermal bonding. Such multi-layers can include metalized film barrier layers to provide permeation resistance. Medical grade multi-layer polymer films can be used for applications requiring sterilization and can include specialized barrier layers designed for drug/physiological liquid compatibility. Multi-layer polymer films can be easily press- or thermally-molded or vacu-formed to shape.

The electrode/through-via geometry shown in FIGS. 7A and 7B can also be used in a direct electrokinetic pump, i.e. without the flexible members 732*a* and 732*b*.

Figure 8:
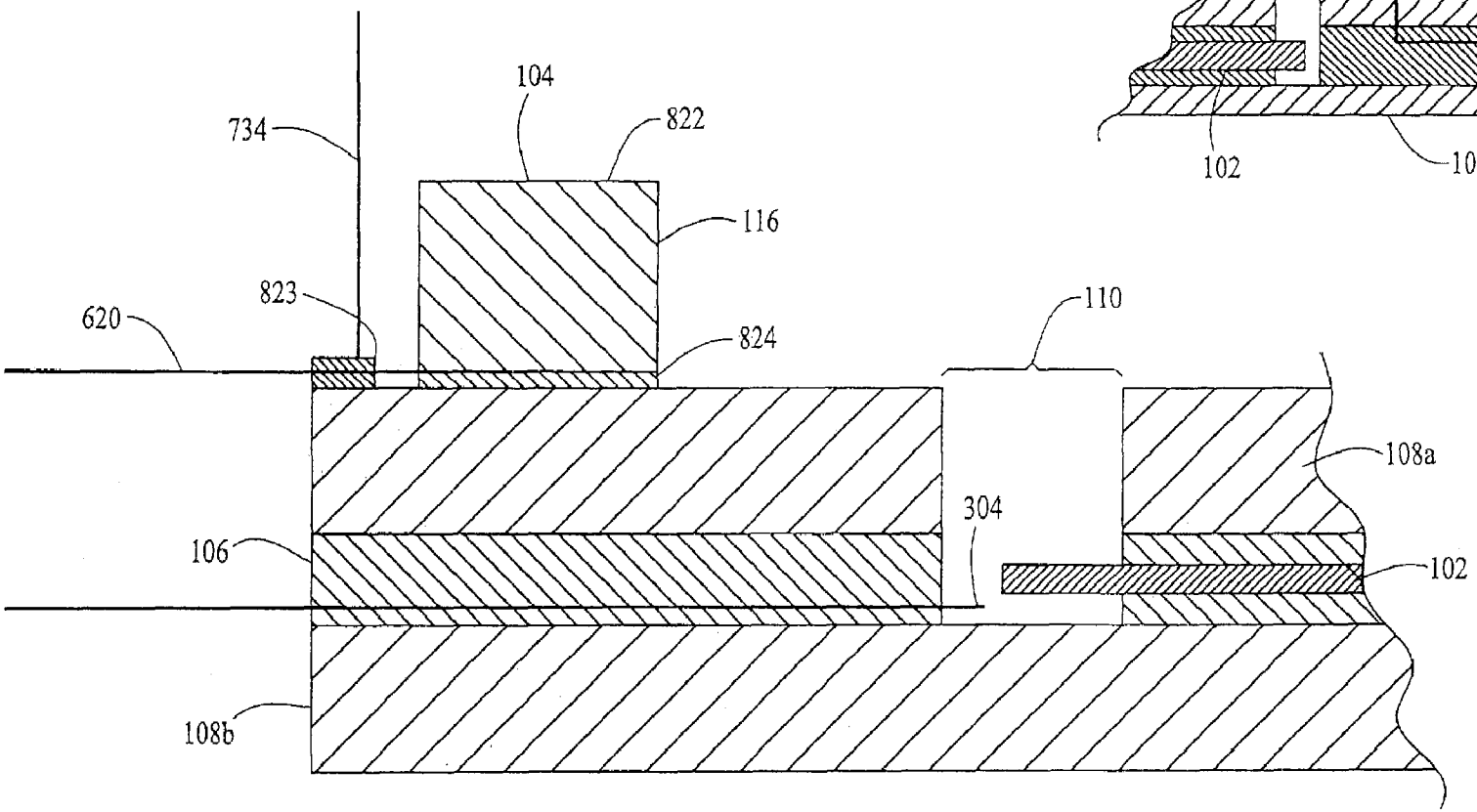
FIG. 8 is a cross-sectional view of a portion of another embodiment of an electrokinetic device in accordance with the present invention.

FIG. 8 shows one way to connect the capacitive electrode 104 and to a lead 620. The lead 620 penetrates a liquid seal 823 between the top substrate 108*a* and enclosure 734 and terminates in electrode bonding material 824 between the capacitive electrode 104 and the top substrate 108*a*. The electric field emanates from the through-via 110 and terminates primarily on the inner surface 116 and to a lesser extent on top 822 of the capacitive electrode 104. Little or no field reaches the section of the lead 620 exposed to the liquid. It is preferable that the terminus of the lead 620 be at least 0.2 mm from faces of the capacitive electrode 104 that carry a substantial fraction of the current, i.e. inner surface 116. Alternatively exposed sections of the lead 620 can be encapsulated in liquid seal material, electrode bonding material 824, varnish or teflon where the insulation is stripped-off the terminal end of the lead in order to make contact with the electrode 104. Examples of liquid seal and electrode bonding materials include adhesives, adhesive-sealants, thermal bond films, silicone or other self-curing rubber-like polymers, epoxies.

FIG. 8 also illustrates one possible configuration that includes the sensor electrode 304. The sensor electrode is simple a lead embedded in the bonding material 106 and protruding into the through-via 110 and making contact with the liquid. The sensor electrode 304 penetrates the through-via 110 slightly below the porous dielectric material 102, in a region of relatively weak electric field. The liquid resistance between the sensor electrode 304 and the porous dielectric material 102 is much less than the liquid resistance between the capacitive electrode 104 and the porous dielectric material. The sensor electrode 304 can be located at any convenient location in the through-via 110, however it is preferable to locate the sensor electrode 304 outside of a direct field path between the porous dielectric material 102 and the capacitive electrode 104 to avoid the possibility of locally shorting out the field by the presence of an object more conducting than the liquid.

Figure 9:
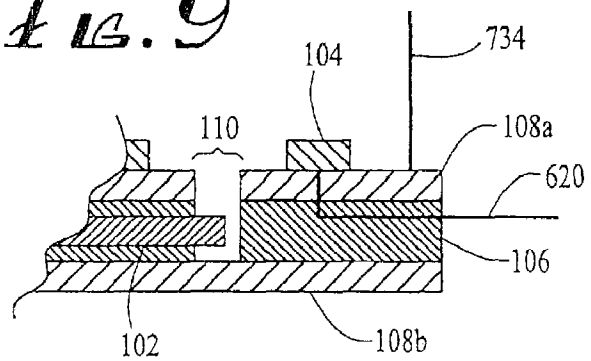
FIG. 9 is a cross-sectional view of a portion of another embodiment of an electrokinetic device in accordance with the present invention.

FIG. 9 shows a further possible connection of the lead 620 to the capacitive electrode 104 in a laminated device. The lead 620 is routed through the bonding material 106 then through the upper substrate 108*a* to make contact with the capacitive electrode 104.

Other specific applications of electrokinetic pumps embodying the invention include, but are not limited to, drug delivery, fuel cells, actuators, and liquid dispensers.

Electrokinetic pumps embodying the invention and using capacitive electrodes have the advantage of compatibility with a nearly unlimited number of chemical systems and gas-free operation.

EXAMPLES

Example 1

In the pump 700 illustrated in FIG. 7A and 7B, substrate 108*a* can be machined to provide the lead and through-via penetrations like those shown in FIG. 9. The through-via penetrations can be about 4 mm in diameter and can be separated by about 30 mm. The porous dielectric material 102 can be porous PVDF with a 150 nm pore size, chemically modified to be hydrophilic and to present nominal −50 mV zeta potential. The porous dielectric material 102 can be about 84 microns thick and cut to a size of about 5×30 mm. The leads 620*a* and 620*b* can be 0.15 mm diameter platinum wire. The electrodes 104*a* and 104*b* can be about 2 mm thick with a 10 mm ID and an 14 mm OD and punched from sheets of porous carbon aerogel that have been washed and leached in deionized water. The flexible impermeable members 732*a* and 732*b* can be 20 mm in diameter and thermoformed from a sheet of 3 mil thick multi-layer polymer, which includes a scratch resistant layer, two gas diffusion barriers, a liquid diffusion barrier, and a thermal adhesion layer. The flexible impermeable members 732*a* and 732*b* can be designed for a nominal displacement of about 2 mL from full compression to full extension. The enclosures 734*a* and 734*b* can be machined from PEI. The ports 114*a* and 114*b* can be standard ¼-28 face seal fittings machined directly into the enclosures 734*a* and 734*b*.

During assembly, the leads 620*a* and 620*b* can be installed in the upper substrate 108*a* with about 10 mm of wire left to fold under the capacitive electrodes 104*a* and 104*b*. The substrates 108*a* and 108*b* and the porous dielectric material 102 can be thermally laminated with 3 layers of thermal bond film as described in patent application Ser. No. 10/198,223. The electrodes 104*a* and 104*b* can be thennally laminated to the exposed side of the upper substrate 108*a* so as to fully cover the exposed leads 620*a* and 620*b*. The flexible impermeable members 732*a* and 732*b* can be thermally spot-tacked in position over the electrodes 104*a* and 104*b* and the enclosures 734*a* and 734*b* are positioned over the flexible imperlneable members. The enclosures 734*a* and 734*b*, the flexible impermeable members 732*a* and 732*b* and the substrates subassembly then can be thermally laminated.

This pump 700 was used to deliver a pure second liquid at a flowrate of 100 nL/min for about one week. The total amount of liquid dispensed was about 1.1 mL. The zeta potential of the porous material was 50 mV hence $n_{eo}$ was about 3.75. TRIS/acetate was used as the pump liquid, the counter-ion mobility was about 4.2 hence $n_{cn}n_{eo}$ was about 1.1. The amount of pump liquid contained within the device was 3 mL, about 3 times the total amount of dispensed liquid. The electrode-liquid potential drop was limited to one Volt. The minimum ionic content within the pump liquid was 2.5 mM. Accounting for the deionization of the liquid over the time of the operation, the starting concentration was about 5 mM. The starting current needed to provide the specified flowrate was about 1.6 micoramperes. The required electrode capacitance to provide the specified flow rate was about 0.75 Farad. This requirement was exceeded by about two times using a porous carbon aerogel electrode material in the shape of an annual ring that is 2 mm high with an inner diameter of 10 mm and an outer diameter of 14 mm. The peak current flux at the electrode calculated to be about 2.5 microAmperes/$cm^2$ which is in accord with the preferred upper limit value. The distribution of current flux on the inner surface of the annular ring satisfied the preferences for flux uniformity. The area-to-length ratio of the porous dielectric material and the supply voltage can be selected, in accord with well-established theory, to meet any additional requirements for pump stall pressure.

Example 2

The electrokinetic device shown in FIG. 6 can be constructed with a dielectric material 102 that is a 100 mm long section of 0.25 mm ID and 0.54 mm OD silica capillary packed with 0.7 micron silica particles. The capacitive electrodes 604*a* and 604*b* can be porous carbon aerogel foam hemispheres machined to have a 2.5 mm inner radius and a 4 mm outer radius. The leads 620*a* and 620*b* can be 22 Ga. titanium wire. The liquid impermeable fixture 628 can be a 9.5 mm long machined cylindrical section of polycarbonate. The capillary can be fixed with an adhesive-sealant in the central bore of the liquid impermeable fixture 628. The capillary can protrude about 0.25 mm from each face of the liquid impermeable fixture 628. Leads 620*a* and 620*b* can be installed in groves in the side of the liquid impermeable fixture 628. The capacitive electrodes 604*a* and 604*b* can be attached with an adhesive to the end-faces of the liquid impermeable fixture 628. The two housing 630*a* and 630*b* can be machined polycarbonate and the ports 114*a* and 114*b* can be standard threaded fittings machined into end faces of the housings. The two housing 630*a* and 630*b* can be slip-fit over the assembled leads 620*a* and 620*b*, the capacitive electrodes 604*a* and 604*b*, and the porous dielectric material 102 and the assembly can be sealed with an adhesive-sealant at the junction of the two housing 630*a* and 630*b*.

Although the emphasis here is on pumps and systems built from discrete components, many of the components presented here apply equally to integrated and/or microfabricated structures.

Although the present invention has been described in considerable detail with reference to preferred versions thereof, other versions are possible. For example: a subsection or extension of the electrode shapes shown can also be used. Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" for "step" clause as specified in 35 U.S.C. § 112.

What is claimed is:

1. An electrokinetic device comprising:

(a) a pair of electrodes capable of having a voltage drop therebetween;

(b) a porous dielectric material between the electrodes; and (c) a through-via in liquid communication with the porous dielectric material;

wherein the electrodes are comprised of a material having a capacitance of at least $10^{-4}$ Farads per square centimeter and each electrode has an inner surface proximate to the porous dielectric material; and, wherein the electrodes are shaped so that the inner surfaces have a current flux of less than about 20 microamperes/$cm^2$ over at least a portion of each inner surface.

2. The device of claim 1 wherein the electrodes have a current flux of less than about 2 microamperes/$cm^2$ over at least a portion of each inner surface.

3. An electrokinetic device comprising:

(a) a pair of electrodes capable of having a voltage drop therebetween;

(b) a porous dielectric material between the electrodes; and, (c) a through-via in liquid communication with the porous dielectric material;

wherein the electrodes are comprised of a material having a capacitance of at least $10^{-4}$ Farads per square centimeter and each electrode has an inner surface proximate to the porous dielectric material, and, wherein the electrodes are shaped so that the inner surfaces have a current flux of less than about 20 microamperes per $cm^2$ over an area of the inner surfaces greater than an effective area of the porous dielectric material.

4. The device of claim 3 wherein the electrodes have a current flux of less than about 2 microamperes/$cm^2$ over an area of the inner surfaces greater than an effective area of the porous dielectric material.

5. An electrokinetic device comprising:

(a) a pair of electrodes having a voltage drop therebetween;

(b) a porous dielectric material between the electrodes; and, (c) a through-via in liquid communication with the porous dielectric material;

wherein the electrodes are comprised of a material having a capacitance of at least $10^{-4}$ Farads per square centimeter and each electrode has an inner surface proximate to the porous dielectric material and the inner surface has a current flux wherein the electrodes are shaped so that the current flux varies by less than a factor of two over at least a portion of each inner surface.

6. The device of claim 5 wherein the current flux varies by less than 20% over at least a portion of each inner surface.

7. The device of claim 5 wherein the current flux is less than about 20 microamperes/$cm^2$ over at least a portion of each inner surface.

8. An electrokinetic device comprising:

(a) a pair of electrodes having a voltage drop therebetween;

(b) a porous dielectric material between the electrodes; and, (c) a through-via in liquid communication with the porous dielectric material;

wherein the electrodes are comprised of a material having a capacitance of at least $10^{-4}$ Farads per square centimeter and each electrode has an inner surface proximate to the porous dielectric material and the inner surface has a current flux wherein the electrodes are shaped so that the current flux varies by less than a factor of two over an area of the inner surfaces greater than an effective area of the porous dielectric material.

9. The device of claim 8 wherein the current flux is less than about 20 microamperes/$cm^2$ over an area of the inner surface greater than an effective area of the porous dielectric material.

10. An electrokinetic device comprising:

(a) a pair of electrodes having a voltage drop therebetween; and, (b) a porous dielectric material between the electrodes;

wherein the electrodes are comprised of a material having a capacitance of at least $10^{-4}$ Farads per square centimeter and each electrode has an inner surface proximate to the porous dielectric material and the inner surface has a current flux wherein the electrodes are shaped so that the current flux varies by less than a factor of two over an area of the inner surfaces greater than an effective area of the porous dielectric material wherein the device is capable of pumping a fluid unidirectionally for a period of time without causing significant electrolysis of the fluid.

11. The device of claim 10 wherein the period of time is at least one day.

12. The device of claim 11 wherein the period of time is at least six days.

13. An electrokinetic device comprising;

(a) a pair of electrodes having a voltage drop therebetween;

(b) a porous dielectric material between the electrodes; and, (c) a through-via in liquid communication with the porous dielectric material;

wherein the electrodes are comprised of a material having a capacitance of at least $10^{-4}$ Farads per square centimeter wherein the shape of the electrodes is substantially annular, spherical, hemispherical, strip-like, elliptical or cylindrical.

14. The device of claim 13 wherein the electrodes have an inner surface proximate to the porous dielectric material and the inner surface has a current flux of less than about 20 microamperes/$cm^2$ over an area of the inner surface greater than an effective area of the porous dielectric material.

15. The device of claim 13 wherein each electrode has an inner surface proximate to the porous dielectric material and the inner surface has a current flux, wherein the current flux varies by less than a factor of two over an area of the inner surface greater than effective area of the porous dielectric material.

16. The device of claim 13 wherein the electrodes have an inner surface proximate to the porous dielectric material and the inner surface has a current flux of less than about 20 microampere s/$cm^2$ over an area of the inner surface greater than an effective area of the porous dielectric material and wherein the current flux varies by less than a factor of two over an effective area of the porous dielectric material.

17. An electrokinetic device comprising:

(a) a pair of capacitive electrodes capable of having a voltage drop therebetween;

(b) a pair of sensor electrodes; and, (c) a porous dielectric material located between the capacitive electrodes and between the sensor electrodes;

wherein the sensor electrodes are attached to an apparatus for measuring the voltage drop across the porous dielectric material.

18. The device of claim 17 further comprising a power supply operatively attached to the capacitive electrodes, wherein the measuring apparatus outputs the voltage drop across the porous dielectric material into the power supply and wherein the power supply adjusts the voltage drop across the porous dielectric material so that fluid moves through the porous dielectric material at a desired rate.

19. An electrokinetic device comprising:

(a) a substrate having a first and a second through-via;

(b) a porous dielectric material located inside the substrate and being in liquid communication with the through-vias;

(c) a first capacitive electrode located on the substrate adjacent to the first through-via, the first capacitive electrode having an inner surface proximate to the first through-via; and, (d) a second capacitive electrode located on the substrate adjacent to the second through-via, the second capacitive electrode having an inner surface proximate to the second through-via;

wherein each inner surface has a current flux and wherein the electrodes are shaped so that the current flux varies by less than a factor of two over an area of the inner surfaces greater than an effective area of the porous dielectric material and wherein the current flux is less than about 20 microamperes/$cm^2$ over an area of the inner surfaces greater than an effective area of the porous dielectric material.

20. An electrokinetic device comprising:

(a) a substrate having a first and a second through-via;

(b) a porous dielectric material located inside the substrate and being in liquid communication with the through-vias;

(c) a first capacitive electrode located on the substrate adjacent to the first through-via, the first capacitive electrode having an inner surface proximate to the first through-via;

(d) a second capacitive electrode located on the substrate adjacent to the second through-via, the second capacitive electrode having an inner surface proximate to the second through-via;

wherein each inner surface has a current flux and wherein the electrodes are shaped so that the current flux varies by less than a factor of two over an area of the inner surfaces greater than an effective area of the porous dielectric material and wherein in the current flux is less than about 20 microamperes/$cm^2$ over an area of the inner surfaces greater than an effective area of the porous dielectric material;

(e) a first flexible barrier encapsulating the first through-via and the first electrode and forming a first reservoir;

(f) a second flexible barrier encapsulating the second through-via and the second electrode and forming a second reservoir;

(g) a first enclosure surrounding the first flexible barrier and having a first port;

(h) a second enclosure surrounding the second flexible barrier and having a second port; and, (i) a conduit connecting the first port to the second port.

21. The device of claim 20 further comprising a voltage drop between the electrodes, wherein the first reservoir contains and the porous dielectric material is saturated with an electrically conducting fluid so that the fluid moves from the first reservoir through the porous dielectric material and into the second reservoir and wherein a working fluid is contained between the second enclosure and the second flexible bather so that as the electrically conducting fluid fills the second reservoir, the second flexible barrier expands and pushes the working fluid through the second port.

22. The device of claim 21 wherein fluid flows unidirectionally through the porous dielectric material for a period of time without significant electrolysis of the electrically conducting fluid.

23. The device of claim 22 wherein the period of time is at least one day.

24. The device of claim 22 wherein the period of time is at least six days.

* * * * *